US008262073B2

(12) United States Patent
Kato et al.

(10) Patent No.: US 8,262,073 B2
(45) Date of Patent: Sep. 11, 2012

(54) SHEET PROCESSING APPARATUS

(75) Inventors: Hitoshi Kato, Toride (JP); Naoki Ishikawa, Kashiwa (JP); Yasuo Fukatsu, Abiko (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/102,881

(22) Filed: May 6, 2011

(65) Prior Publication Data

US 2011/0281708 A1 Nov. 17, 2011

(30) Foreign Application Priority Data

May 14, 2010 (JP) ..... 2010-112290

(51) Int. Cl.
*B31F 1/08* (2006.01)

(52) U.S. Cl. ..... 270/51; 270/32; 270/45; 270/58.07; 493/406; 493/435; 493/437; 493/444; 493/445

(58) Field of Classification Search ..... 270/32, 270/37, 45, 51, 58.07; 493/406, 415, 435, 493/437, 442, 444, 445, 454
See application file for complete search history.

(56) References Cited

U.S. PATENT DOCUMENTS

2004/0183246 A1* 9/2004 Jung et al. ..... 270/37
2008/0315489 A1* 12/2008 Iguchi et al. ..... 270/37
2010/0278577 A1* 11/2010 Hubbard et al. ..... 399/407

FOREIGN PATENT DOCUMENTS

JP 2006-036493 A 2/2006

* cited by examiner

*Primary Examiner* — Leslie A Nicholson, III
(74) *Attorney, Agent, or Firm* — Canon USA, Inc., IP Division

(57) ABSTRACT

A sheet processing apparatus includes a pushing member, a drive device, a first conveyance unit, a second conveyance unit provided on a downstream side of the first conveyance unit, a first detection unit, a second detection unit, and a control unit. The drive device moves the pushing member to push a portion of a sheet bundle to fold the sheet bundle. The first conveyance unit uses a roller pair to convey the folded sheet bundle folded. The second conveyance unit conveys the sheet bundle. The first detection unit detects an amount by which the pushing member is moved by the drive device. The second detection unit detects an amount by which the sheet bundle is conveyed by the first conveyance unit. The control unit separates the roller pair based on the amounts detected by the first and second detection units.

7 Claims, 8 Drawing Sheets

SHEET PROCESSING APPARATUS

BACKGROUND OF THE INVENTION

1. Field of the Invention

The present invention relates to a sheet processing apparatus for performing a post-processing on a folded portion of a stacked sheet bundle.

2. Description of the Related Art

Conventionally, there exist image forming apparatuses such as copying machines, printers, and multifunction peripherals which are equipped with a sheet processing apparatus for performing folding processing on sheets on which images have been formed by an image forming unit. However, a sheet bundle that has undergone folding processing can swell. Accordingly, in a conventional sheet processing apparatus, in order to improve the quality of the folded portion and stacking property, flattening processing is performed after the folding of a sheet bundle to flatten a curved top of the folded portion, which is formed through the folding of the sheet bundle.

To flatten the fold top portion, the sheet processing apparatus conveys the folded sheet bundle by a conveyance roller, and causes the fold top portion to strike a positioning member to set it in position. Next, the sheet processing apparatus holds a vicinity of the fold top portion of the sheet bundle by a grasping member to fix it in position, and then retreats the positioning member; after this, a press contact roller travels along the fold top portion while in press contact with the fold top portion of the sheet bundle, thereby flattening the fold top portion.

In such a sheet processing apparatus, when there is variation in the position where the fold top portion of the sheet bundle stops, an amount by which the press contact roller enters the sheet bundle varies, resulting in variation of the configuration of the fold top portion. Therefore, in the sheet processing apparatus as discussed in Japanese Patent Application Laid-Open No. 2006-036493, the sheet bundle is caused to strike a positioning member, thereby enhancing the precision of the stopping position of the sheet bundle.

However, in the case where the sheet bundle is stopped by providing a positioning member, it is necessary to provide the positioning member, a motor for causing the positioning member to retreat, etc. This results in an increase in the cost of the sheet processing apparatus and complicates its structure. On the other hand, in the case where the sheet bundle is stopped without providing any positioning member, depending upon the length of the sheet bundle, the trailing edge of the sheet bundle may stop near the nip portion of conveyance rollers. In this case, the sheet bundle is pushed out to the downstream side by the pressure of the nip portion of the conveyance rollers, so that the stopping position of the sheet bundle may be deviated. In the following, the deviation of the stopping position of the sheet bundle due to the pushing-out will be discussed.

The larger the number of sheets constituting the sheet bundle, the larger the gap of the conveyance roller pair due to the increase in the thickness of the sheet bundle. On the other hand, the trailing edge of the sheet bundle folded in the middle is of a triangular configuration protruding toward the upstream side. If the trailing edge of the sheet bundle is near the nip of the conveyance rollers when the sheet bundle is stopped, the gap of the conveyance roller pair is eliminated, so that the conveyance roller pair pushes out the triangular portion at the trailing edge of the sheet bundle. As a result, the positional relationship between the press contact roller and the sheet bundle is deviated, resulting in variation of the configuration of the fold top portion.

To solve the above problem, if the distance between the stopping position of the sheet bundle and the conveyance rollers on the downstream side is not less than half the maximum sheet length which enables double folding, it might be possible to prevent the pushing-out phenomenon of the conveyance roller pair at the time of stopping the sheet bundle. However, that would involve an increase in the length of the conveyance path, resulting in an increase in the apparatus size.

It is also possible to separate the conveyance rollers near the trailing edge of the sheet bundle. In this case, it is necessary to separate the conveyance rollers after the sheet bundle has reached conveyance rollers on the downstream side of conveyance rollers near the trailing edge of the sheet bundle. To determine whether the sheet bundle has reached the downstream conveyance rollers, an optical sensor can be added to detect the position of the sheet bundle. However, that would require a sensor, a structure for mounting the sensor, etc., resulting in an increase in cost and complicating a structure.

Further, instead of the above method, it is possible to separate the conveyance rollers when a fixed period of time has elapsed after the start of the folding of the sheet bundle in the middle. However, the load on the motor at the time of folding the sheet bundle in the middle varies depending upon the number of sheets constituting the sheet bundle, a type of paper used, etc., resulting in fluctuation in the required time for folding the sheet bundle in the middle. As a result, if, for example, the load is large, and the required time for folding in the middle is long, the upstream side conveyance rollers are separated before the sheet bundle reaches the downstream conveyance rollers, so that the sheet bundle may not be normally conveyed.

SUMMARY OF THE INVENTION

According to an aspect of the present invention, a sheet processing apparatus includes: a pushing member for pushing a portion of a sheet bundle to be folded, to thereby fold the sheet bundle; a drive device configured to move the pushing member; a first conveyance unit having a roller pair which conveys the sheet bundle folded by the pushing member, wherein the roller pair can be separated; a second conveyance unit provided on a downstream side of the first conveyance unit and configured to convey the sheet bundle; a first detection unit configured to detect an amount by which the pushing member is moved by the drive device; a second detection unit configured to detect an amount by which the sheet bundle is conveyed by the first conveyance unit; and a control unit configured to separate the roller pair based on the amount which is detected by the first detection unit and the amount which is detected by the second detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A sheet conveyance apparatus describe below works towards stopping, with high precision, a sheet folded in the middle. The sheet conveyance apparatus may realize, at low cost, a stabilization of the finished configuration of the fold portion of a sheet folded in the middle.

Figure 1:
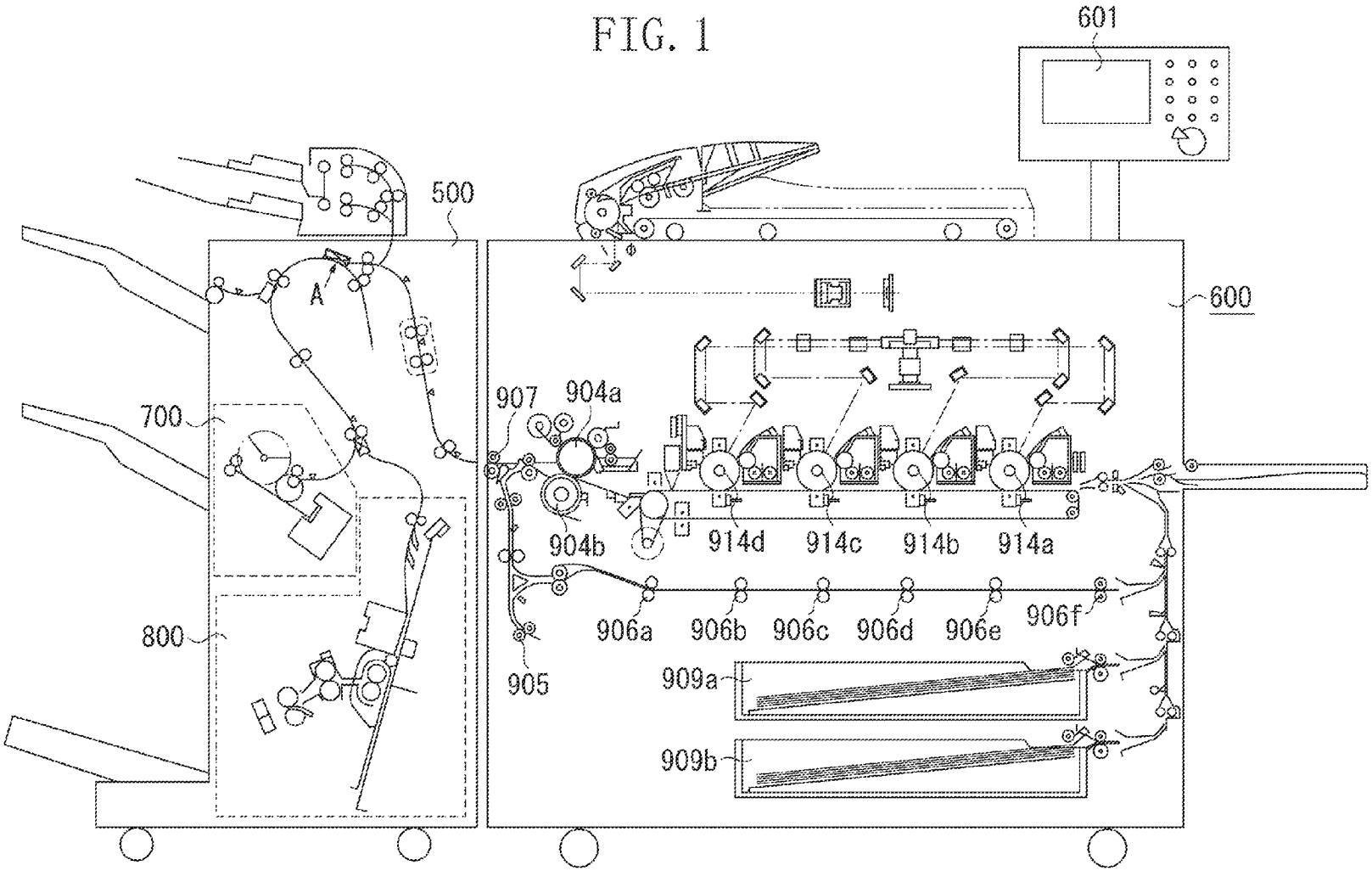
FIG. 1 is a front view of an image forming apparatus and a sheet processing apparatus.

FIG. 1 is a schematic diagram illustrating the construction of an image forming apparatus and a sheet processing apparatus. As illustrated in FIG. 1, a saddle stitch binding apparatus 500 is connected to the image forming apparatus. The image forming apparatus 600 and the saddle stitch binding apparatus 500 may be integrated with a sheet discharge apparatus. A position where the user faces an operation unit 601 to conduct various input/setting operations on the image forming apparatus 600 will be referred to as the front side of the image forming apparatus (hereinafter simply referred to as the front side), and the rear side of the apparatus will be referred to as the depth side. Toner images are formed on photosensitive drums 914*a* through 914*d* in yellow, magenta, cyan, and black image forming units. The formed images are superimposed and transferred onto a sheet S supplied from a cassette 909*a*, 909*b* in the image forming apparatus 600. The sheet S is conveyed to a fixing device 904, where the transferred toner images are fixed on the sheet by a pressurization roller 904*a* and a fixing roller 904*b*. In the case of a one-sided image formation mode, the sheet is discharged as it is to the outside of the apparatus from a discharge roller pair 907. In the case of a two-sided image formation mode, the sheet S is delivered from the fixing device 904 to a reverse roller 905, and is conveyed in a direction toward duplex conveyance rollers 906*a* through 906*f*. Then, toner images of four colors are transferred to the back surface. The sheet S that has undergone two-sided transfer is conveyed again to the fixing device 904, where the toner images are fixed before discharging the sheet to the outside of the apparatus from the discharge roller pair 907.

Figure 2:
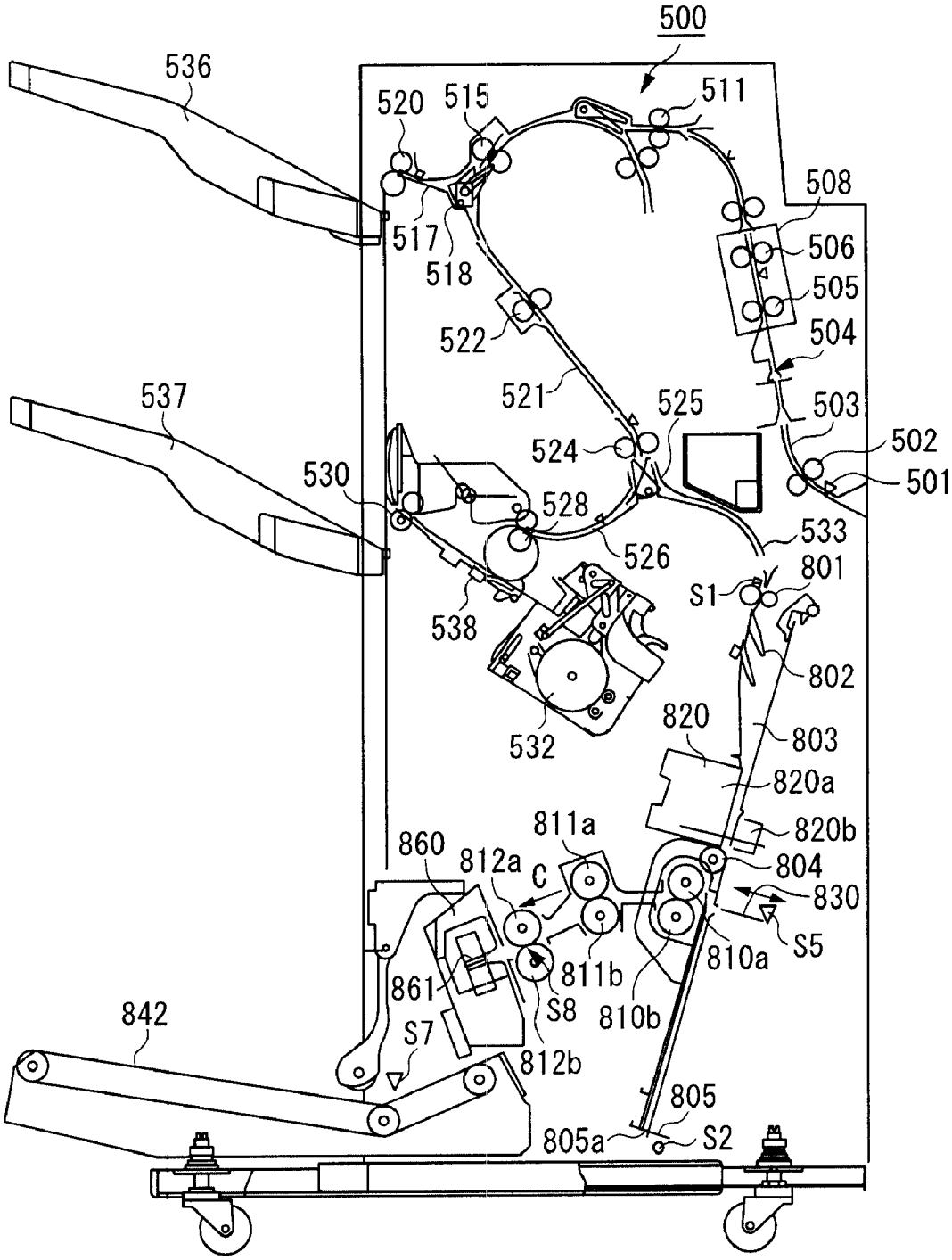
FIG. 2 is a front view illustrating in detail the sheet processing apparatus.

FIG. 2 is a schematic diagram illustrating the construction of the saddle stitch binding apparatus 500 as the sheet processing apparatus. The saddle stitch binding apparatus 500 is composed of a side stitch binding unit 700 and a saddle stitch binding unit 800. The sheet S discharged from the image forming apparatus 600 is delivered to an inlet roller pair 502 of the saddle stitch binding apparatus 500. At this time, an inlet sensor 501 detects the timing with which the sheet is to be delivered. The sheet S conveyed by the inlet roller pair 502 passes through a conveyance path 503, and during this passage, an end portion in a width direction of the sheet, which is orthogonal to the sheet conveyance direction, is detected by an end detection sensor 504. As a result, it is detected to what degree an error in conveyance position has been generated with respect to a conveyance center position in the width direction.

After an error in conveyance position in the width direction has been detected, while the sheet S is sandwiched and conveyed by shift roller pairs 505 and 506, a shift unit 508 moves in the front/depth direction by an amount corresponding to the error in conveyance position, thus, a sheet shift operation is executed. As a result, the position of the sheet in the width direction is corrected.

After this, the sheet S, which is conveyed by a conveyance roller pair 511, is conveyed by a buffer roller pair 515. In the case where the sheet S is discharged to an upper discharge tray 536, an upper path switching member 518 is guided to an upper path conveyance path 517 by a drive unit such as a solenoid (not illustrated), and the sheet is discharged to the upper discharge tray 536 by an upper discharge roller pair 520.

When the sheet S is discharged to a portion other than the upper discharge tray 536, the sheet S, which is conveyed by the buffer roller pair 515, is guided to a bundle conveyance path 521 by the upper path switching member 518. After this, the sheet S is successively conveyed within the conveyance path by a buffer roller pair 522 and a bundle conveyance roller pair 524. When saddle processing (saddle stitching) is performed on the sheet, a saddle path switching member 525 is moved by a drive unit such as a solenoid (not illustrated), and the sheet S is conveyed to a saddle path 533. After this, the sheet S is guided to the saddle stitch binding unit 800 by a saddle inlet roller pair 801 to the saddle stitch binding unit 800 to perform saddle stitch binding (saddle processing).

When the sheet S is discharged to a lower discharge tray 537, the sheet S, which is conveyed by a bundle conveyance roller pair 524, is conveyed to a lower path 526 by a saddle switching member 525. The sheet S is discharged to a processing tray 538 as a second stacking tray by a lower discharge roller pair 528, and undergoes stitching processing by a stapler 532 in a processing tray 538 before discharged to a lower discharge tray 537 by a discharge roller pair 530 as a bundle discharge unit.

Next, the construction of the saddle stitch binding unit 800 of the sheet processing apparatus 500 will be described.

The sheet conveyed to the saddle stitch binding unit 800 is delivered to a saddle inlet roller pair 801, and is carried into an accommodation guide 803 as a sheet stacking unit through a carry-in port of a size conforming to the sheet size. The carry-in port is selected by a switching member 802 operated by a solenoid (not illustrated). The carried-in sheet continues to be conveyed by a roller 804.

The saddle inlet roller pair 801 and the roller 804 are driven by a saddle stitch inlet roller motor M1, and is controlled by the output of a saddle stitch inlet sensor S1. The sheet, which has been conveyed to the accommodation guide 803, is conveyed, according to the sheet size (the length of the sheet in the conveyance direction) until its end (the downstream end in the conveyance direction) abuts on an end stopper 805 previously moved to a predetermined position. Driven by an end stopper moving motor M2, the stopper 805 can move in the sheet conveyance direction along the sheet guide surface of the accommodation guide 803. The end stopper 805 is controlled by the output of an end stopper movement sensor S2. Further, the end stopper 805 has a regulation surface 805*a* protruding from the accommodation guide 803, and, the regulation surface 805*a* causes the end stopper 805 to receive and retain the downstream end in the conveyance direction of the sheet, which is conveyed to the accommodation guide 803. In this way, the sheet is stacked on the accommodation guide 803.

A stapler 820 is arranged at a position opposite to the accommodation guide 803, and stitches the middle portion in the conveyance direction of a bundle consisting of a plurality of sheets accommodated in the accommodation guide 803. The stapler 820 is divided into a driver 820*a* which projects a staple, and an anvil 820*b* which bends the projected staple; when the accommodation of a sheet bundle is completed, it staples the middle portion in the conveyance direction of the sheet bundle.

On the downstream side of the stapler 820, a folding roller pair 810*a*, 810*b* and a pushing member 830 are provided opposing each other across the accommodation guide 803. The folding roller pair 810*a*, 810*b* and the pushing member 830 function as a folding unit for double folding the sheet bundle accommodated in the accommodation guide 803 at the middle portion in the conveyance direction.

The pushing member 830 is a plate-like member, and projects toward the middle portion in the conveyance direction of the sheet bundle accommodated in the accommodation guide 803, driven and moved by a pushing motor M3 to enter the nip portion of the folding roller pair 810*a*, 810*b*. More specifically, the pushing member 830 and the pushing motor M3 function as a pushing unit. The pushing member 830 is controlled by the output of a pushing sensor S3 whose home position is retracted from the accommodation guide 803 and by the output of a pushing encoder sensor S5 detecting the rotation amount of the pushing motor M3. As a result, the operation of folding the sheet bundle in the middle is performed, with the sheet bundle pushed into the nip of the folding roller pair 810*a*, 810*b*.

The folding roller pair 810*a*, 810*b* double-folds the sheet bundle, and conveys the folded sheet bundle toward a first fold conveyance roller pair 811*a*, 811*b*. More specifically, the folding roller pair 810*a*, 810*b* also functions as a first conveyance unit.

After the projecting operation of the pushing member 830 is completed, and the folding line side (leading edge) of the sheet bundle reaches the first fold conveyance roller pair 811*a*, 811*b*, the folding roller pair 810*a*, 810*b* is changed from a press contact state to a separated state by a separation mechanism portion. After this, the pushing member 830 returns to the home position again. The method of detecting arrival at the first fold conveyance roller pair 811*a*, 811*b*, and the roller separation mechanism portion, will be described in detail below.

The leading edge of the sheet bundle at which the folding line has been drawn by the folding roller pair 810 is conveyed to a press unit 860 via a second fold conveyance roller pair 812*a*, 812*b* and stops there. At this time, depending upon the sheet size, the position of an end portion on the side opposite to the folding line of the sheet bundle may coincide with the nip position of the folding roller pair 810, 810*b*. For example, in the present exemplary embodiment, the maximum sheet size allowing double-folding is the A3 wide size.

Further, to achieve a reduction in apparatus size, the distance from the sheet stopping position for the press processing (which consolidates a folding line) by the press unit 860, to the folding roller pair 810*a*, 810*b* is not larger than half the longitudinal length of the A3 wide size and substantially coincides with half the longitudinal length of the A3 wide size. Accordingly, when the sheet size is A3 wide, the edge side position of the sheet bundle coincides with the nip position of the folding roller pair 810*a*, 810*b*.

In the case of a thick sheet bundle folded in the middle, an inclined surface is usually generated in the end surface between the innermost sheet and the outermost sheet; due to the nip pressure of the folding roller pair 810*a*, 810*b* given to the inclined surface, a force moving the sheet bundle in the downstream direction is generated. As a result, the precision of a stopping position becomes unstable. In view of this, after the leading edge on the folding line side of the sheet bundle reaches the first fold conveyance roller pair 811*a*, 811*b*, the folding roller pair 810*a*, 810*b* is changed from the press contact state to the separated state. As a result, the nip pressure of the folding roller pair 810*a*, 810*b* is not given to the inclined surface, and the sheet bundle may not be pushed out. Thus, the precision in the stopping of the sheet bundle after its conveyance to the press unit 860 is stabilized.

The press roller pair 861 of the press unit 860 moves along the folding line of the booklet while pressing the spine portion of the sheet bundle (booklet), whereby a pressing processing is executed on the folding line.

After the execution of the pressing by the press unit 860, the sheet bundle is conveyed in the downstream direction to be discharge to a folded bundle discharge tray 842. The folded bundle discharge tray 842 is constituted by a belt conveyor, and is rotated by a folded bundle discharge tray motor M7.

After the discharge of the sheet bundle, the folded bundle discharge tray 842 is rotated until the folded bundle discharge tray sensor S7 ceases to detect the sheet bundle, and the discharged sheet bundle is moved successively in the downstream direction and stacked. The folding roller pair 810, the first fold conveyance roller pair 811, the second fold conveyance roller pair 812 are driven by a fold conveyance motor M4, and the rotation speed is controlled by using a fold conveyance sensor S4. The fold conveyance sensor S4 detects pulses generated from an optical encoder mounted on the rotation shaft of the motor M4, thereby detecting the RPM and the rotation speed of the motor M4.

Figure 8:
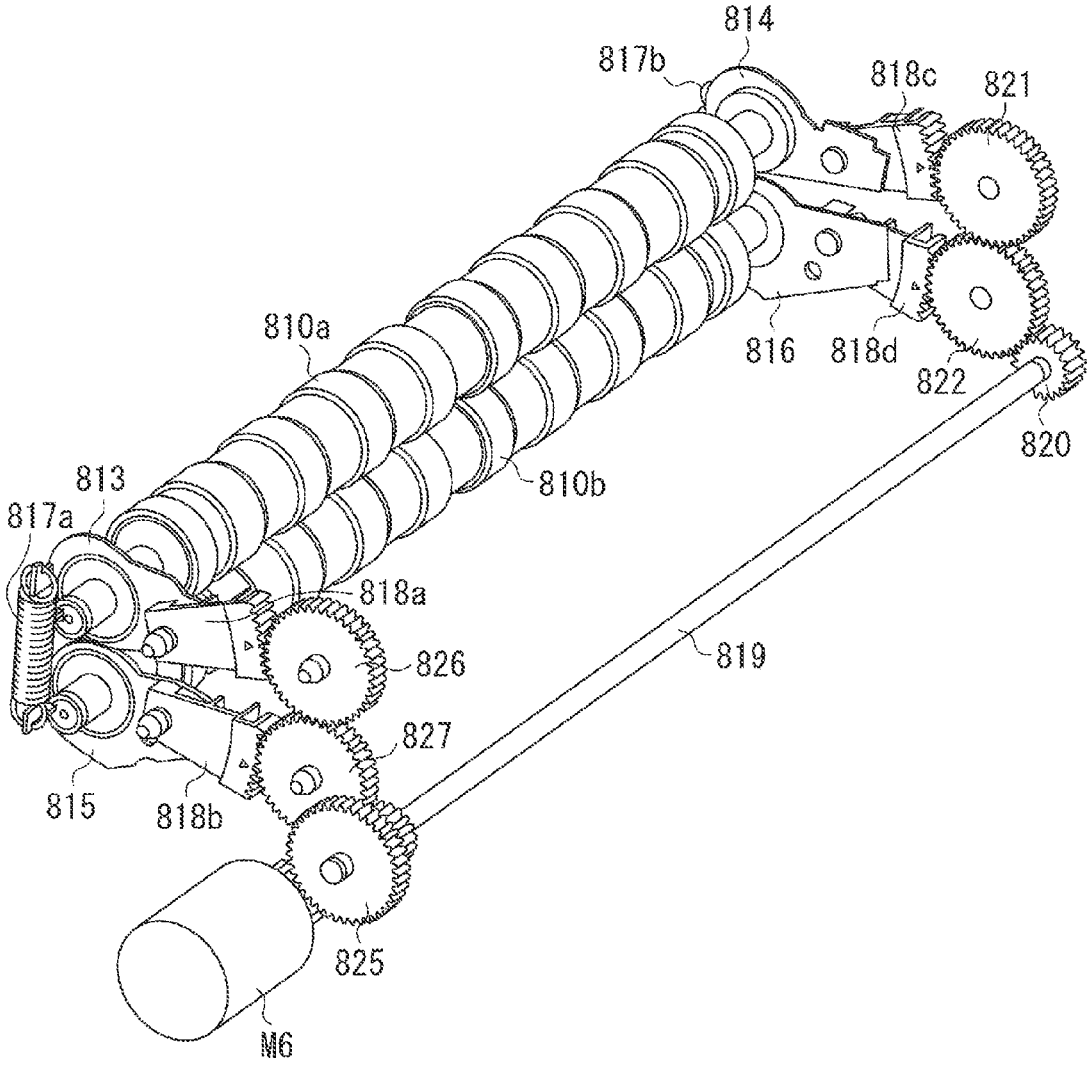
FIG. 8 is a perspective view of a roller separation mechanism.

The roller separation mechanism separating the folding roller pair 810*a*, 810*b* will be described with reference to FIG. 8. FIG. 8 is a perspective view of the roller separation mechanism. The folding roller pair 810*a*, 810*b* is supported at both ends via bearing members 832*a* through 832*d* by an upper roller arm plate (front) 813, an upper roller arm plate (depth) 814, a lower roller arm plate (front) 815, and a lower roller arm plate (depth) 816. Between the upper roller arm plate 813 and the lower arm plate 815 and between the upper roller arm plate 814 and the lower roller arm plate 816, press springs 817*a* and 817*b* for sandwiching and holding press contact between the rollers are respectively latched.

In the roller separation drive portion, driving force is transmitted from a roller separation drive motor M6 to a sector gear 818*a* mounted on the upper roller arm plate 813 and a sector gear 818*b* mounted on the lower arm plate 815 via driving force transmission gears 825, 826, and 827. Further, a driving force transmission shaft 819 and a driving force transmission gear 820 are arranged coaxially with the driving force transmission gear 825. The driving force of a motor M6 is transmitted to a sector gear 818*c* mounted on the upper roller arm plate 814 and a sector gear 818*d* mounted on the lower roller arm plate 816 via driving force transmission gears 821 and 822. Thus, the roller separation drive motor M6 as the separation unit is driven, whereby it is possible to synchronously separate the front side and depth side rollers.

Figure 3:
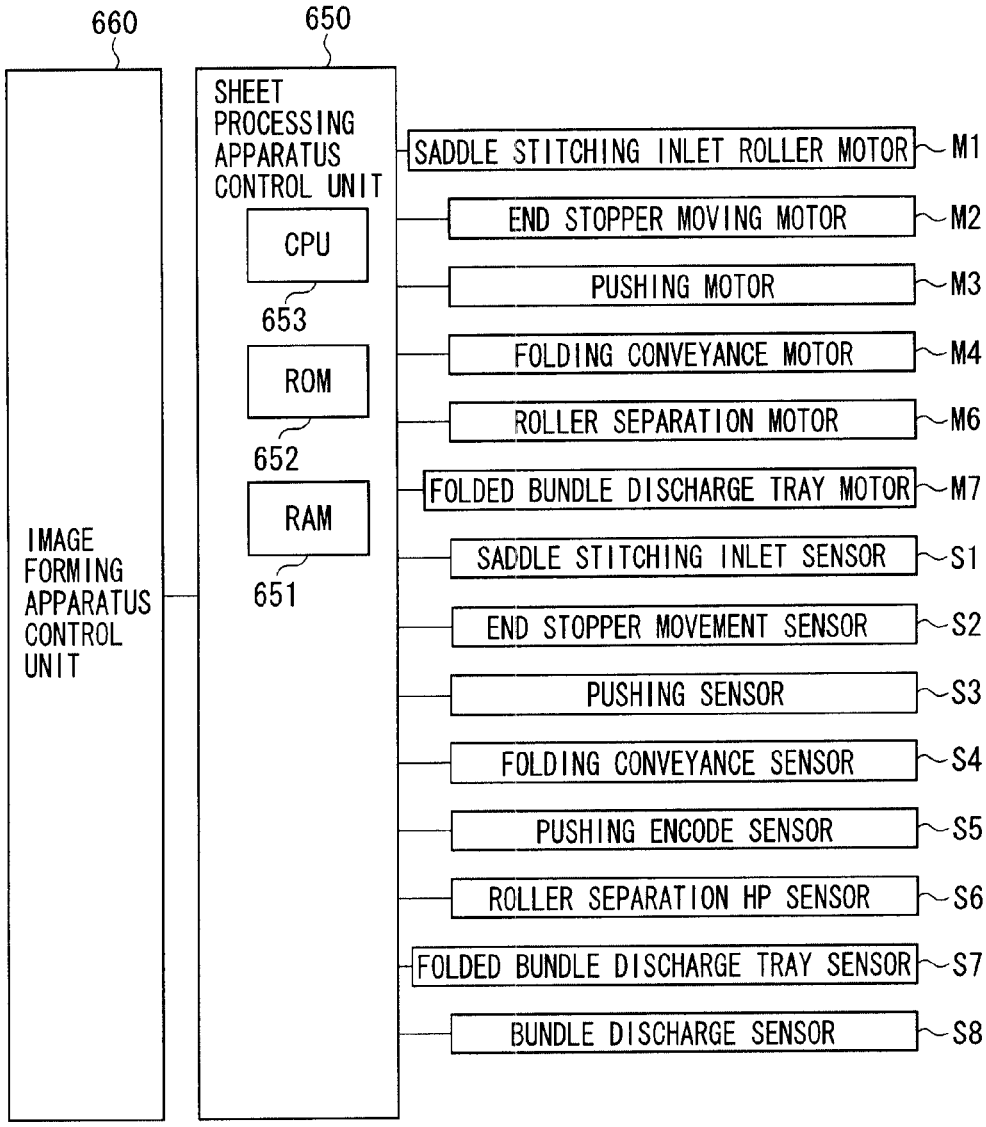
FIG. 3 is a control block diagram illustrating the sheet processing apparatus.

Next, a description will be given with reference to FIG. 3, which is a control block diagram for the sheet processing apparatus executing the above control. A sheet processing apparatus control unit 650 is mounted, for example, on the sheet processing apparatus 500; it performs communication with an image forming apparatus control unit 660, and controls the operation of the sheet processing apparatus 500 based on an instruction from the image forming apparatus control unit 660. The sheet processing apparatus control unit 650 has a read-only memory (ROM) 652 storing various programs and data, a central processing unit (CPU) executing the various programs stored in the ROM 652, and a random-access memory (RAM) 651 functioning as a work area for the CPU 653.

Further, the sheet processing apparatus control unit 650 controls the saddle stitching inlet roller motor M1, the end stopper moving motor M2, the pushing motor M3, the fold conveyance motor M4, the roller separation motor M6, and the folded bundle discharge tray motor M7. Further, the sheet processing apparatus control unit 650 inputs signals from the saddle stitching inlet sensor S1, the end stopper movement sensor S2, the pushing sensor S3, the fold conveyance sensor S4, the pushing encoder sensor S1, the roller separation home position (HP) sensor S6, and the folded bundle discharge tray sensor S7, and controls each unit.

Figure 4:
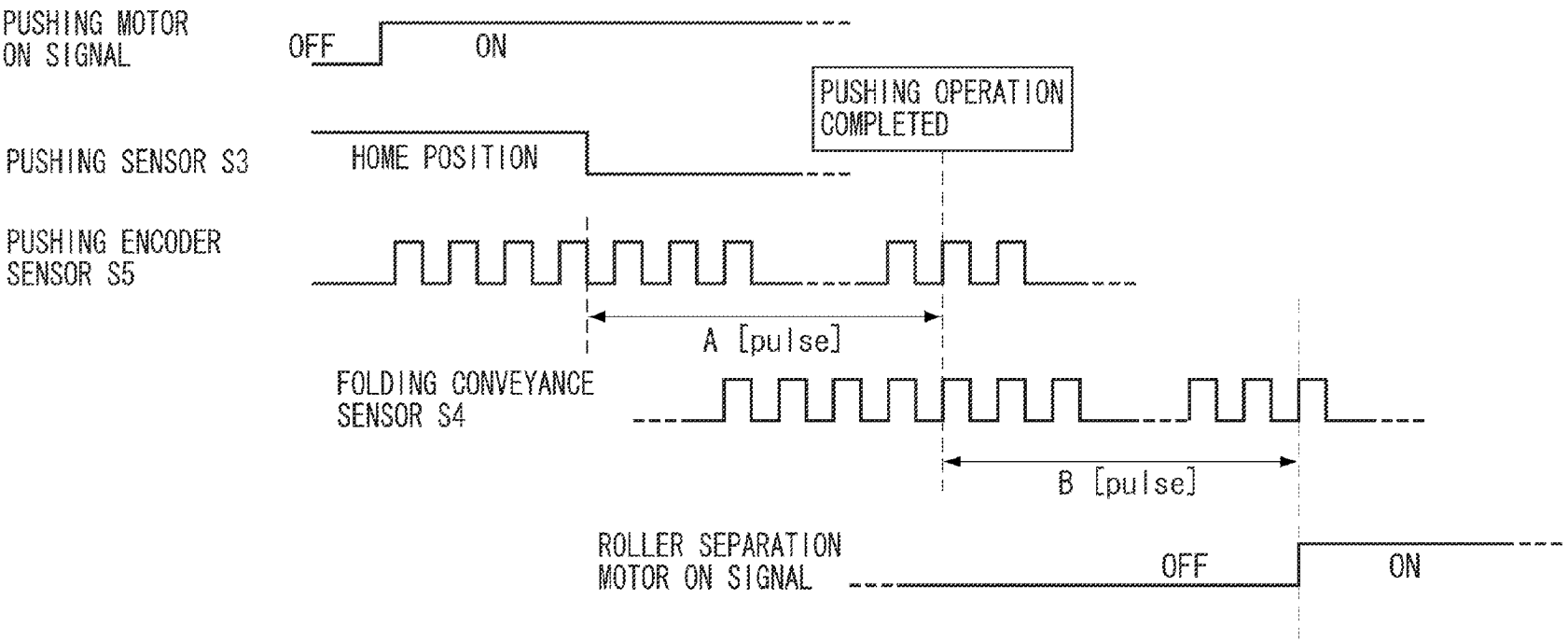
FIG. 4 is a timing chart illustrating the timing with which a roller pair is separated.
Figure 5:
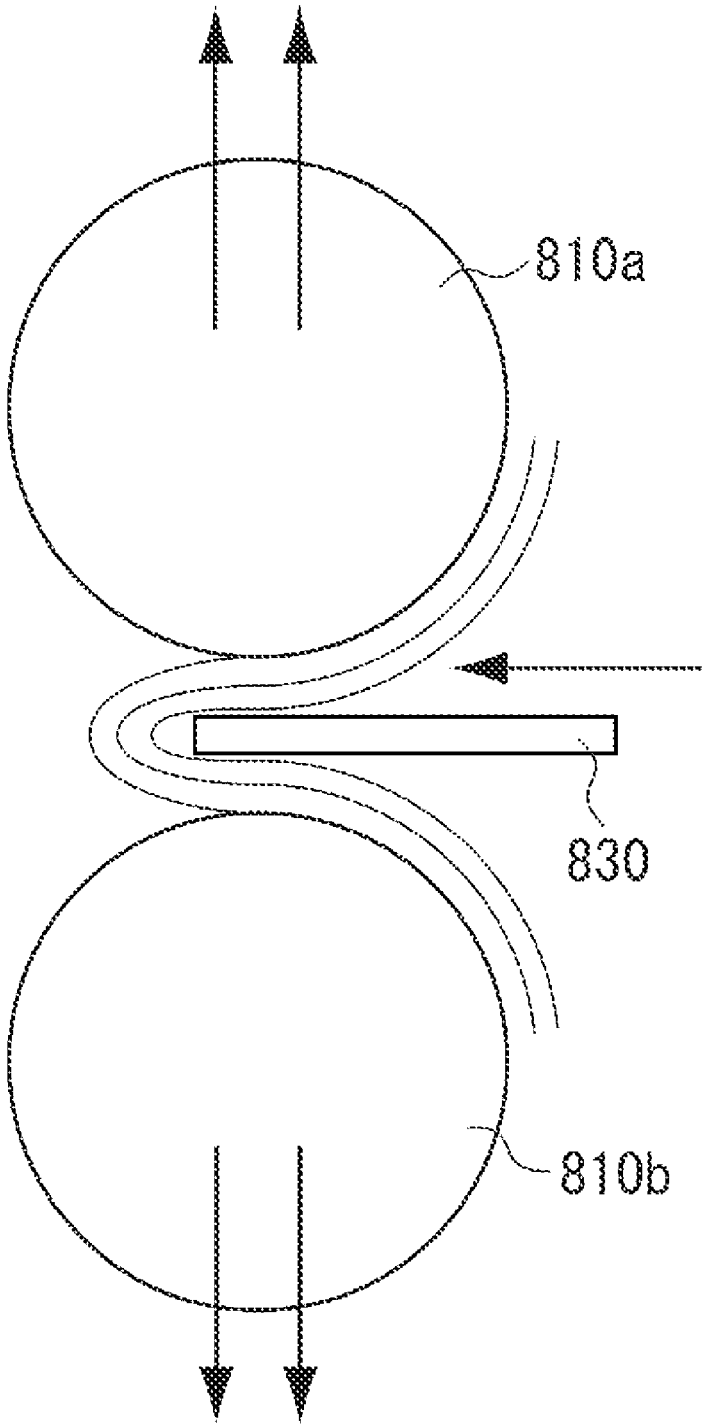
FIG. 5 is a sectional view of a folding roller pair.

Next, a method of detecting the arrival of the sheet bundle leading edge at the first fold conveyance roller pair 811*a*, 811*b* will be described. FIG. 4 is a timing chart, of the pushing sensor S3, the pushing encoder sensor S5, an driving signal for driving the pushing motor M3, the fold conveyance sensor S4, and an driving signal for driving the roller separation motor M6. FIG. 5 is a diagram illustrating a state in which the operation of pushing the sheet bundle by the pushing member 830 has been completed.

As illustrated in FIG. 5, until the completion of the pushing operation of the pushing member 830, the leading edge of the sheet bundle moves in conformity with the pushing member 830. Thus, when the pushing operation of the pushing member 830 has been completed (when the pushing has been effected to the end), the leading edge of the sheet bundle is nipped between the folding roller pair 810*a*, 810*b*. The pushing completion position is detected when, as illustrated in FIG. 4, the pulse count number of the pushing encoder sensor S5 has attained a predetermined number A (first amount) after it is detected that a predetermined portion of the pushing member 830 has left the home position.

Figure 7:
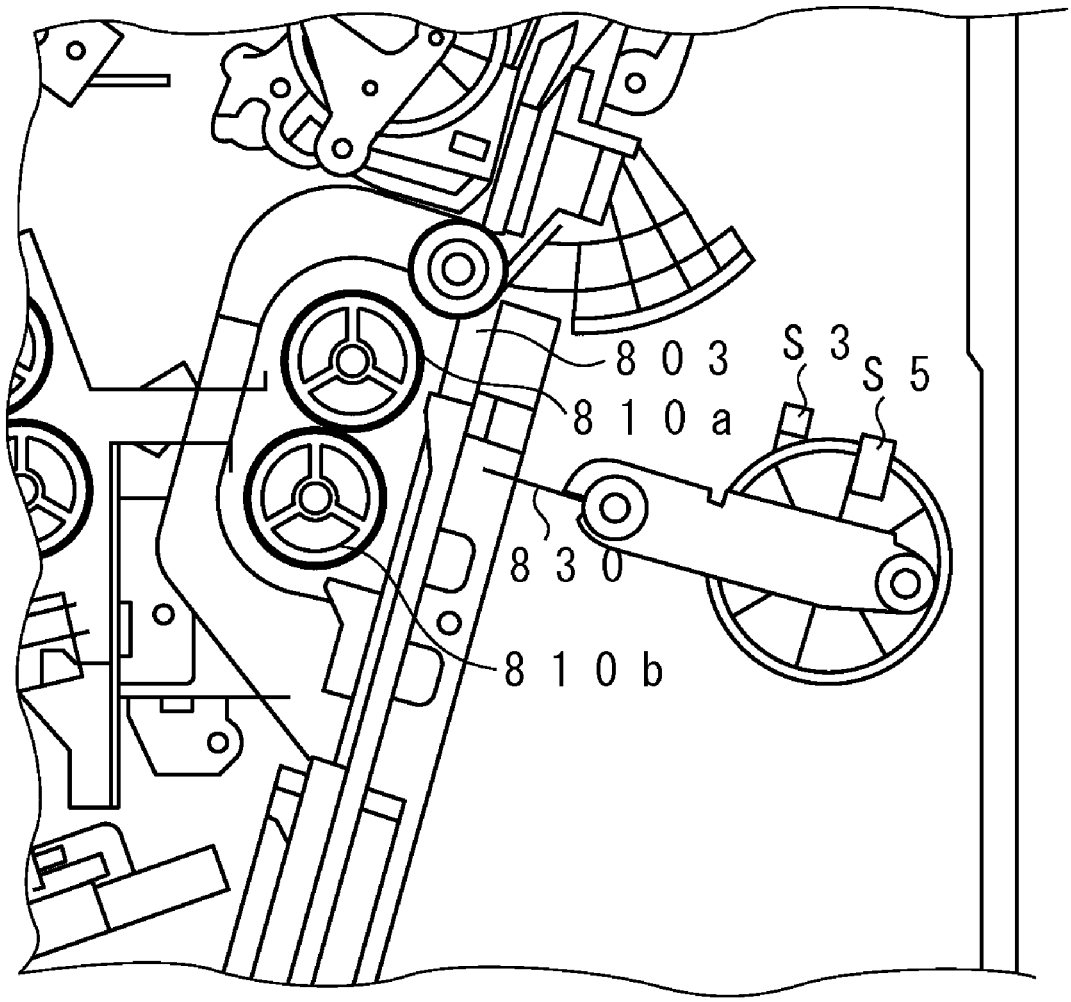
FIG. 7 is a sectional view of a pushing member.

The position of the leading edge of the sheet bundle when the count number has attained the predetermined number A is a position, where the leading edge of the sheet bundle, which has reached the folding roller pair 810*a*, 810*b*, is nipped. As illustrated in FIG. 7, the home position of the pushing member 830 is a position retracted from the accommodation guide 803. When the pushing member 830 leaves the home position, the pushing sensor S3 is turned off.

After the completion of the pushing operation has been detected, the pulses of the fold conveyance sensor S4 are counted to a predetermined number B (second amount), so that it is detected that the leading edge of the sheet bundle has reached the first fold conveyance roller pair 811*a*, 811*b*. The position of the leading edge of the sheet bundle when the count number has attained the predetermined number B is on the upstream side of the stopping position of the sheet bundle.

In this way, until the sheet bundle reaches the folding roller pair 810*a*, 810*b* through the pushing operation and is nipped, the pulses from the pushing sensor S3 are counted; after the sheet bundle is nipped, the pulses from the fold conveyance sensor S4 are counted. By changing the pulses to be counted halfway through, it is possible to determine with precision that the sheet bundle has reached the first fold conveyance roller pair 811*a*, 811*b*.

When it is determined that the sheet bundle has reached the first fold conveyance roller pair 811*a*, 811*b*, the folding roller pair 810*a*, 810*b* is separated. Thus, thereafter, the sheet bundle is conveyed toward a press unit by the first fold conveyance roller pair 811*a*, 811*b*. More specifically, the first fold conveyance roller pair 811*a*, 811*b* functions as a second conveyance unit.

Figure 6:
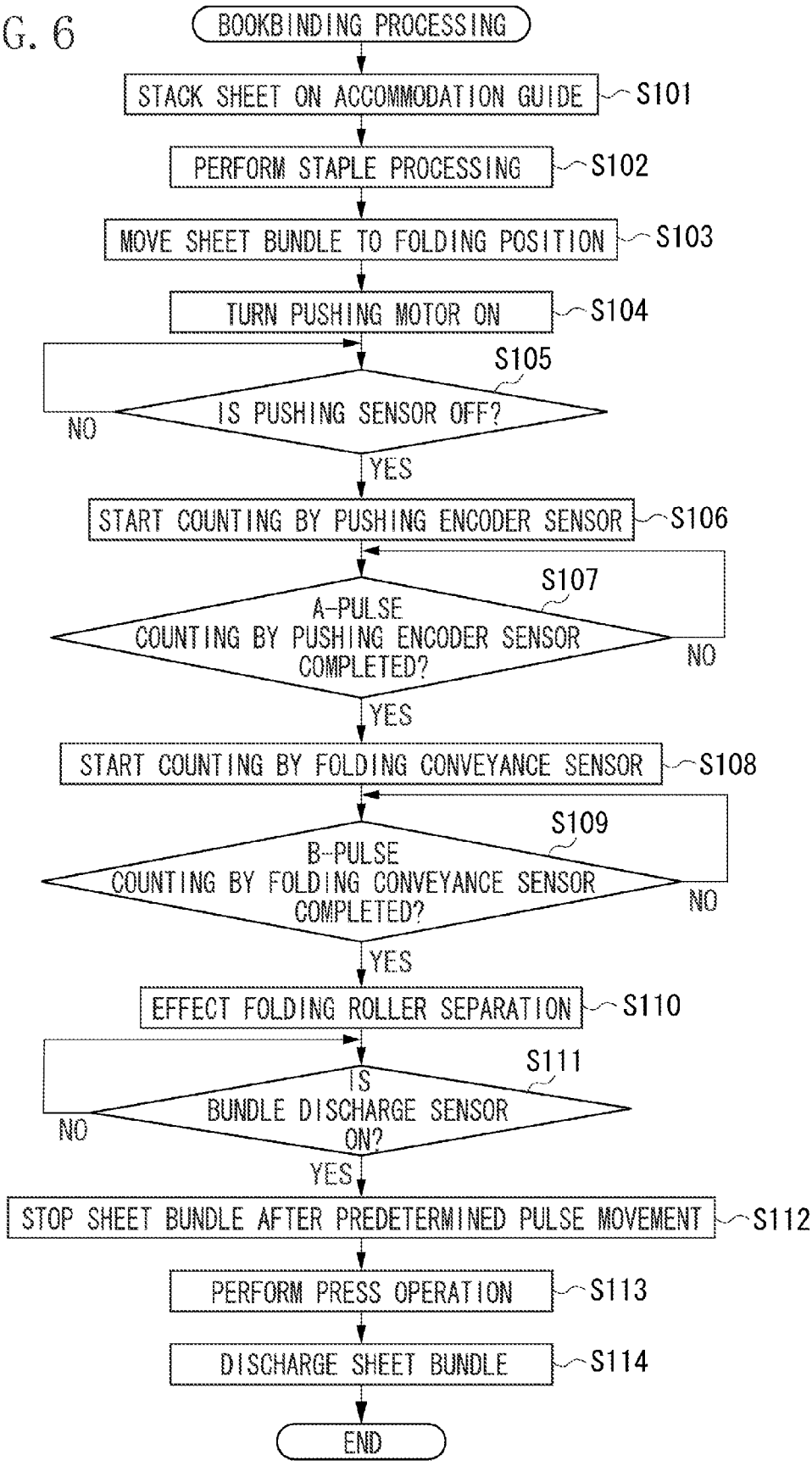
FIG. 6 is a flowchart illustrating binding processing.

Next, a bookbinding processing control flow will be described with reference to FIG. 6. The bookbinding processing control flow is executed when the CPU 653 of the sheet processing apparatus control unit 650 receives an instruction to execute bookbinding processing from the image forming apparatus control unit 660. First, the CPU 653 conveys the sheets, which have been conveyed from the image forming apparatus, to the end stopper 805 by controlling the driving of the saddle stitching inlet roller motor M1, and stacks the sheets on the accommodation guide 803 (S101). When it is determined that the stacking of all the sheets has been completed, the CPU 653 causes the stapler 820 to perform stapling on the sheet bundle (S102).

After the detection of the final sheet by the saddle stitching inlet sensor S1, the CPU 653 determines that the stacking of all the sheets has been completed upon the completion of the conveyance of the sheets to the end stopper.

Next, the CPU 653 moves the sheet bundle to the folding position where the operation of folding the bundle in the middle is performed (S103). When the movement of the sheet bundle to the folding position has been completed, the CPU 653 turns on the pushing motor M3, and starts pushing operation by the pushing member 830 (step S104).

When the pushing sensor S3 is turned off, in other words, when the pushing member 830 leaves the home position (S105), the CPU 653 starts to count the pulses from the pushing encoder sensor S5 to measure the movement amount of the pushing member 830 (S106). When it is determined that the count number of the pulses from the pushing encoder sensor S5 has reached a value A (S107), the CPU 653 starts to count the pulses from the fold conveyance sensor S4 (S108).

When the pulses from the fold conveyance sensor S4 are counted, the movement amount (conveyance amount) of the sheet bundle conveyed by the folding roller pair 810*a*, 810*b* is measured. The point where the pushing member 830 has moved A pulses is the point where the pushing-in of the sheet bundle into the folding roller pair 810*a*, 810*b* by the pushing member 830 has been completed. While the fold conveyance motor M4 starts to be driven before the sheet bundle reaches the folding roller pair 810, it is also possible for the motor to start to be driven simultaneously with the driving of the pushing motor M3.

When it is confirmed that the count number of the pulses from the fold conveyance sensor S4 has attained the predetermined number B (S109), the CPU 653 causes the motor M6 to operate to separate the folding roller pair 810*a*, 810*b* (S110). When the number of pulses from the fold conveyance sensor S4 has attained the predetermined number B, the leading edge of the sheet bundle has reached the first fold conveyance roller pair 811*a*, 811*b*. After this, the CPU 653 confirms that the bundle discharge sensor S8 has been turned on (S111), and then counts the pulses from the fold conveyance sensor S4 to a predetermined number C before stopping the sheet bundle (S112). More specifically, the bundle discharge sensor S8 is used to obtain the timing for stopping the sheet bundle at the stopping position for press processing.

In the present exemplary embodiment, the folding roller pair 810, the first fold conveyance roller pair 811, and the second fold conveyance roller pair 812 are driven by the same motor M4, so that, even after the separation of the folding roller pair 810, the pulses from the fold conveyance sensor S4 are counted. However, in the case where the first fold conveyance roller pair 811 and the second fold conveyance roller pair 812 are driven by a motor independent of the motor M4, pulses synchronous with the driving of that motor are counted.

Next, the CPU 653 causes the press unit 860 to perform press processing on the folding line of the sheet bundle (S113). When the press processing is over, the CPU 653 discharges the sheet bundle (S114), thereby completing the bookbinding processing.

As described above, until the pushing operation by the pushing member 830 with respect to the sheet bundle is completed (until the sheet bundle is nipped by the folding roller pair 810), the CPU 653 determines the moving position of the sheet bundle based on the driving amount of the pushing motor M3 moving the pushing member 830. After the pushing operation has been completed, and the sheet bundle has been nipped by the folding roller pair 810, the CPU 653 determines the moving position of the sheet bundle based on the driving amount of the fold conveyance motor M4 driving the folding roller pair 810. This makes it possible to accurately detect the position of the sheet bundle without adding a component such as a sensor. As a result, the conveyance rollers is separated with an appropriate timing, making it possible to suppress variation in the stopping position due to the pushing-out of the sheet bundle and to realize at low cost stabilization of the finished configuration of the fold top portion.

The first fold conveyance roller pair 811*a*, 811*b* which can be separated like the folding roller pair 810*a*, 810*b* is also feasible. In this case, it is possible to prevent the sheet bundle pushing-out phenomenon even in the case of a sheet size which causes the trailing edge of the sheet bundle to be situated at the nip portion of the first fold conveyance roller pair 811*a*, 811*b* when the sheet bundle double-folded is stopped at the stopping position.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112290 filed May 14, 2010, which is hereby incorporated by reference herein in its entirety.

What is claimed is:

1. A sheet processing apparatus, comprising:

a pushing member for pushing a portion of a sheet bundle to be folded, to thereby fold the sheet bundle;

a drive device configured to move the pushing member;

a first conveyance unit having a roller pair which conveys the sheet bundle folded by the pushing member, wherein the roller pair can be separated;

a second conveyance unit provided on a downstream side of the first conveyance unit and configured to convey the sheet bundle;

a first detection unit configured to detect an amount by which the pushing member is moved by the drive device;

a second detection unit configured to detect an amount by which the sheet bundle is conveyed by the first conveyance unit; and a control unit configured to separate the roller pair based on the amount which is detected by the first detection unit and the amount which is detected by the second detection unit.

2. The sheet processing apparatus according to claim 1, wherein the control unit separates the roller pair after it is detected by the first detection unit that the amount by which the pushing member is moved has attained a first amount which causes the pushing member to reach the roller pair, in response to detection by the second detection unit that the amount by which the sheet bundle is conveyed has attained a second amount which causes the sheet bundle to reach the second conveyance unit.

3. The sheet processing apparatus according to claim 1, further comprising a press unit provided on a downstream side of the second conveyance unit and configured to press a folding line of the sheet bundle stopped at a predetermined position.

4. The sheet processing apparatus according to claim 3, wherein the control unit separates the roller pair before the sheet bundle stops at the predetermined position.

5. The sheet processing apparatus according to claim 3, wherein a distance between the predetermined position and the first conveyance unit is not more than half a maximum sheet length allowing the sheet processing apparatus to perform folding.

6. The sheet processing apparatus according to claim 1, wherein the pushing member is a plate-like member, and the control unit controls the drive device such that a leading edge of the pushing member enters a nip portion of the roller pair.

7. The sheet processing apparatus according to claim 1, wherein the first detection unit detects the amount by which the pushing member is moved, by counting pulses synchronous with driving of the drive device, and the second detection unit detects the amount by which the sheet bundle is conveyed, by counting pulses synchronous with driving of the roller pair.

* * * * *